US005647066A

United States Patent [19]

Joslin et al.

[11] Patent Number: 5,647,066

[45] Date of Patent: Jul. 15, 1997

[54] SAFETY HELMET VISOR

[76] Inventors: Edward G. Joslin, 1407 7th Ave., Neptune, N.J. 07753; James Selzer, 201 Larine Ave., Apt. 501, Bradley Beach, N.J. 07754

[21] Appl. No.: 445,689

[22] Filed: May 22, 1995

[51] Int. Cl.[6] ..... A42B 3/22

[52] U.S. Cl. ..... 2/424; 2/10; 2/909

[58] Field of Search ..... 2/424, 425, 422, 2/9, 10, 909, 918, 12, 423, 6.3, 6.7

[56] References Cited

U.S. PATENT DOCUMENTS

| | | | |
|---|---|---|---|
| 2,679,047 | 5/1954 | Bozzi | 2/12 |
| 4,229,836 | 10/1980 | Stinger | 2/424 X |
| 4,811,430 | 3/1989 | Janusz | 2/909 X |
| 4,852,189 | 8/1989 | Duggan | 2/909 X |
| 4,856,535 | 8/1989 | Forbes | 2/9 X |
| 5,067,174 | 11/1991 | Ritchey et al. | 2/10 |
| 5,105,475 | 4/1992 | Lynd et al. . | |
| 5,177,810 | 1/1993 | Minton et al. | 2/10 |
| 5,208,916 | 5/1993 | Kelman . | |
| 5,365,615 | 11/1994 | Piszkin . | |

*Primary Examiner*—Peter Nerbun
*Attorney, Agent, or Firm*—Harpman & Harpman

[57] ABSTRACT

An adjustable safety helmet visor that extends for protection for the face by providing a simple one-piece adjustable add-on visor that will fit a multitude of helmet configurations. The visor is formed of a pre-cut deformable synthetic resin material that is removably secured to the helmet by continuous bands of interengageable hook and loop material along its edges.

3 Claims, 2 Drawing Sheets

SAFETY HELMET VISOR

BACKGROUND OF THE INVENTION

1. Technical Field

This device relates to safety helmets and associated face shields that provide protection to the user from wind and ancillary impact with foreign objects.

2. Description of Prior Art

Prior art devices of this type have relied on a variety of different face shield configurations that are positioned on safety helmets for motorcycles and the like, see for example U.S. Pat. Nos. 5,105,475, 5,208,916 and 5,365,651.

In U.S. Pat. No. 5,105,475, a head gear with eye glass is disclosed wherein the head gear is provided with a head element adapted to be worn by a person which includes an eye shield carried by the head element which can be movably positioned with respect to the head element in either shielding or covering position relative to the wearers eyes or in a stored position. The device is pivotally secured to a portion of the head gear so that it can be moved away from the wearer's eyes as noted.

In U.S. Pat. No. 5,208,916 a sunglass assembly for visored head gear is disclosed in which the head gear includes a mounting device on which can be positioned a lens in front of the wearer's eyes extending from the brim portion of a cap. The device is designed to clip over the brim portion and have a movable adjustable mounting fixture for the transparent plastic or glass.

Finally, in U.S. Pat. No. 5,365,615 a head gear face shield with non-invasive universal mounting is disclosed in which a plastic face shield is illustrated being removably positioned by mechanical fasteners about a portion of the head gear so as to extend over the person's face in spaced relation thereto.

SUMMARY OF THE INVENTION

A one-piece adjustable safety visor for sport helmets and the like that provides for a flexible self-contained transparent face shield protection. The safety visor is removably secured to the helmet of choice by a strip of mated hook and loop material bonded to the edge portion of the visor and its respective mating strip of hook and loop material adhesively secured to the helmet above and about the face opening. The safety visor can be adjustably cut to size by guide lines superimposed on a releasable sheet thereon.

DESCRIPTION OF THE PREFERRED EMBODIMENT

Figure 1:
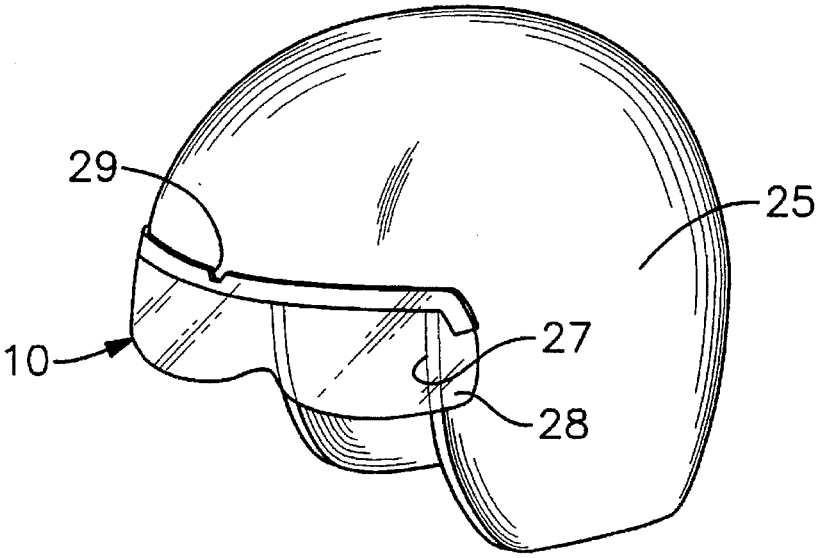
FIG. 1 is a perspective view of a helmet with the safety visor of the invention attached thereto.
Figure 2:
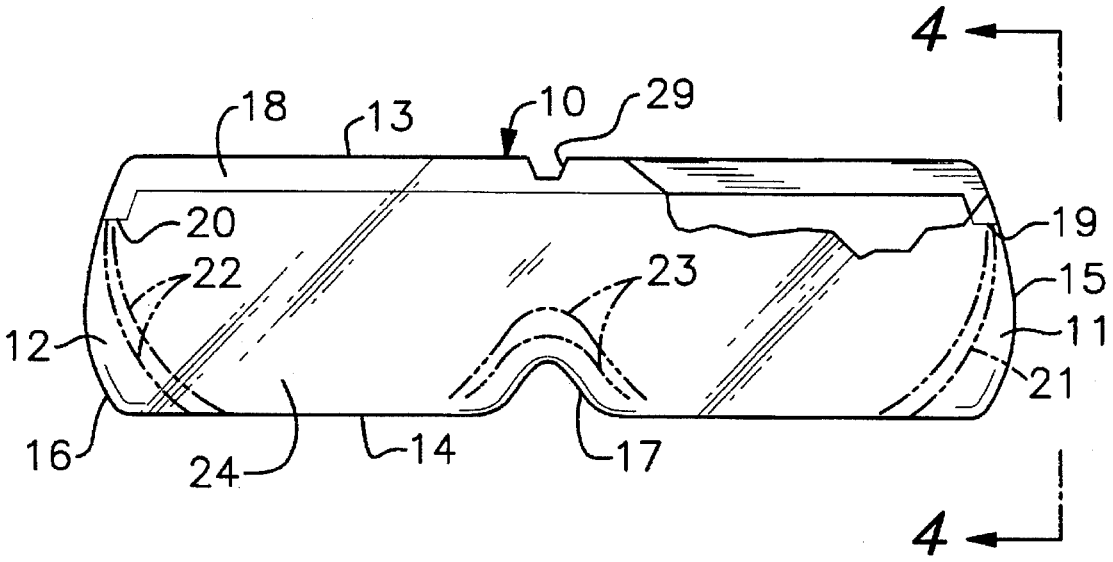
FIG. 2 is an enlarged front elevational view of the safety visor.
Figure 4:
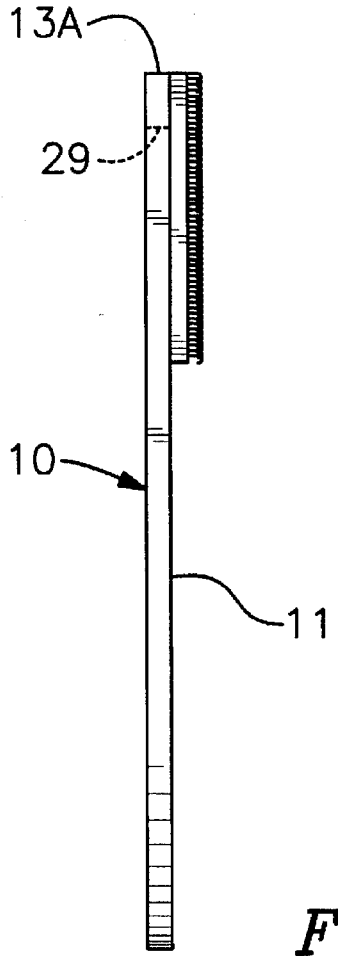
FIG. 4 is an end plan view on lines 4—4 of FIG. 2.

Referring to FIGS. 1, 2, and 4 of the drawings, a safety visor 10 can be seen having a generally flat rectangular sheet configuration defining oppositely disposed ends 11 and 12 with parallel extending upper and lower edges 13 and 14 interconnecting between said respective ends 11 and 12. Each of the ends 11 and 12 define oppositely disposed contoured rounded curved edges 15 and 16.

The lower edge 14 has a curved notch 17 midway between said respective ends 11 and 12. The notch 17 extends inwardly in an arcuate fashion into the body of the safety visor 10 to provide the required comfort clearance for the user (not shown) as will be well understood by those skilled in the art.

Figure 3:
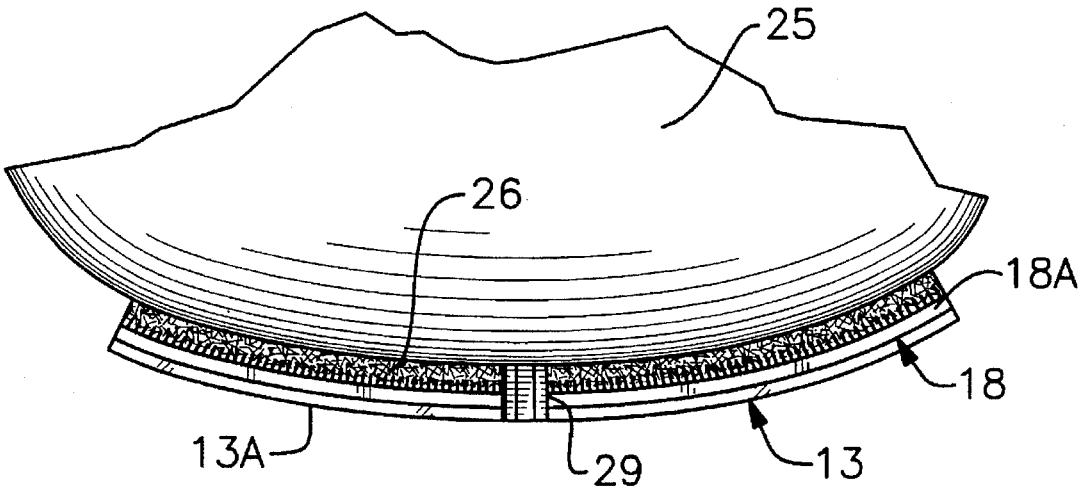
FIG. 3 is a top plan view of the safety visor of the invention positioned on a portion of a helmet.

The upper edge 13 of the safety visor 10 is defined as a squared off edge finish 13A with an elongated band 18 of hook and loop material (Velcro brand*) bonded thereon and extending inwardly therefrom as best seen in FIGS. 2, 3 and 4 of the drawings. The band 18 is in this embodiment the hook portion 18A of the hook and loop material which is commonly available. The band 18 extends the entire length of the safety visor 10 and downwardly along each of its end portions 12 and 13 to a determined distance indicated at 19 and 20 respectively.

Referring now to FIG. 2 of the drawings, a plurality of broken guide lines 21, 22 and 23 are superimposed onto the safety visor 10 adjacent its respective ends 11 and 12 and notch 17. The guide lines 21, 22 and 23 are formed on a * Velcro is a Registered Trademark releasable sheet 24 of thin flexible transparent material so as to provide guides for cutting the visor sheet therealong to custom shapes to fit a variety of helmet configurations (not shown) to which the invention could be applied.

Referring now to FIGS. 1 and 3 of the drawings, in use, the safety visor 10 of the invention is secured to a registering strip of loop material 26 secured to a helmet 25 by interengaging the safety visor's band 18 of hook material 18A to the corresponding strip of loop material 26 on the safety helmet 25 about its face open edge at 27. The visor 10 thus secured extends in overlapping relationship on selective portions 28 of the safety helmet 25 as best seen in FIG. 1 of the drawings. The safety visor 10 is made from a transparent synthetic resin material that may be colored or tinted as required or desired as is well known to those skilled in the art.

It will thus be seen that a new and novel safety visor attachment has been illustrated and described and it will be apparent to those skilled in the art that various changes and modifications may be made thereto without departing from the spirit of the invention.

Therefore I claim:

1. In combination, a safety visor having spaced parallel upper and lower edges and a safety helmet having selective rigid engagement portions, said safety visor comprising; a flat sheet of flexible translucent material of a length greater than its width, said sheet having contoured oppositely disposed ends with selectively removable portions, a band of hook and loop material secured to the safety visor along its upper edge thereof and extending from said upper edge along remaining portions of said opposing contoured ends, an adjustable notch in said lower edge midway between said ends, a band of hook and loop material secured to said selective rigid engagement portions of said safety helmet registerable with said band of hook and loop material on said safety visor, said adjustable notch in said lower edge has selectively removable portions defined by multiple spaced guidelines thereon.

2. The combination set forth in claim 1 wherein said flat sheet of flexible translucent material is comprised of a synthetic resin compound.

3. The combination set forth in claim 1 wherein said flat sheet of flexible translucent material is tinted.

* * * * *